US010370881B2

(12) United States Patent
Goldman

(10) Patent No.: US 10,370,881 B2
(45) Date of Patent: Aug. 6, 2019

(54) TELESCOPIC LOCK

(71) Applicant: KNOCK N'LOCK LTD., Yokneam (IL)

(72) Inventor: Ilan Goldman, Herzliya (IL)

(73) Assignee: KNOCK N'LOCK LTD., Yokneam (IL)

( * ) Notice: Subject to any disclaimer, the term of this patent is extended or adjusted under 35 U.S.C. 154(b) by 200 days.

(21) Appl. No.: 15/310,304

(22) PCT Filed: May 12, 2015

(86) PCT No.: PCT/IL2015/050494
§ 371 (c)(1),
(2) Date: Nov. 10, 2016

(87) PCT Pub. No.: WO2015/173808
PCT Pub. Date: Nov. 19, 2015

(65) Prior Publication Data

US 2017/0159335 A1 Jun. 8, 2017

(30) Foreign Application Priority Data

May 14, 2014 (IL) ..... 232618

(51) Int. Cl.

| | |
|---|---|
| ***E05C 9/04*** | (2006.01) |
| ***E05B 47/06*** | (2006.01) |
| ***E05B 47/00*** | (2006.01) |
| ***E05B 47/02*** | (2006.01) |
| ***E05B 65/06*** | (2006.01) |
| ***E05C 1/08*** | (2006.01) |
| ***E05C 5/00*** | (2006.01) |

(Continued)

(52) U.S. Cl.
CPC ..... *E05C 9/043* (2013.01); *E05B 47/0004* (2013.01); *E05B 47/0012* (2013.01); *E05B 47/026* (2013.01); *E05B 47/06* (2013.01); *E05B 65/06* (2013.01); *E05C 1/08* (2013.01); *E05C 5/00* (2013.01); *E05C 9/048* (2013.01); *E05B 17/0079* (2013.01); *E05B 17/2011* (2013.01); *E05B 2047/0069* (2013.01); *E05B 2047/0094* (2013.01)

(58) Field of Classification Search
CPC ..... E05B 47/0004; E05B 47/0012; E05B 47/026; E05B 47/06; E05B 65/06; E05B 17/0079; E05B 17/2011; E05B 2047/0069; E05B 2047/0094; E05C 9/043; E05C 9/048; E05C 1/08; E05C 5/00
USPC ..... 70/277
See application file for complete search history.

(56) References Cited

U.S. PATENT DOCUMENTS 3,576,337 A * 4/1971 Gudde ..... E05B 51/02 292/196
4,015,454 A * 4/1977 Struble ..... E05C 1/08 292/150

(Continued)

FOREIGN PATENT DOCUMENTS

| | | | |
|---|---|---|---|
| CN | 102839862 | A | 12/2012 |
| WO | 98/39539 | A1 | 9/1998 |
| WO | 01/59238 | A2 | 8/2001 |

*Primary Examiner* — Suzanne L Barrett
(74) *Attorney, Agent, or Firm* — Vorys, Sater, Seymour and Pease LLP

(57) ABSTRACT

Provided is a telescopic lock that can be fixed to a variety of closures of different configurations to thereby provide another closure protection measure.

19 Claims, 9 Drawing Sheets

(51) Int. Cl.
*E05B 17/20* (2006.01)
*E05B 17/00* (2006.01)

(56) References Cited

U.S. PATENT DOCUMENTS

| | | | | | |
|---|---|---|---|---|---|
| 4,993,757 | A * | 2/1991 | Corzine | E05B 47/0002 | 292/144 |
| 5,282,656 | A * | 2/1994 | Fizer | E05C 19/003 | 292/259 R |
| 5,487,289 | A | 1/1996 | Otto, III et al. | | |
| 5,911,460 | A * | 6/1999 | Hawkins | E05B 63/248 | 292/144 |
| 5,941,578 | A * | 8/1999 | Shamblin | E05B 47/026 | 292/144 |
| 6,125,673 | A | 10/2000 | Luker | | |
| 7,484,391 | B1 * | 2/2009 | Moore | B65D 90/008 | 292/144 |
| 7,559,585 | B2 * | 7/2009 | Plesternings | B60J 7/1851 | 292/201 |
| 7,784,315 | B2 * | 8/2010 | Yang | E05C 9/026 | 292/DIG. 32 |
| 8,720,239 | B2 * | 5/2014 | Crass | B25H 3/028 | 70/256 |
| 8,752,870 | B2 * | 6/2014 | Wolf | E05C 17/20 | 292/144 |
| 9,062,479 | B2 * | 6/2015 | Wolf | E05B 65/0888 | |
| 2009/0308117 | A1 | 12/2009 | Goldman | | |
| 2014/0054906 | A1 | 2/2014 | Wolf | | |

* cited by examiner

TELESCOPIC LOCK

TECHNOLOGICAL FIELD

This disclosure is in the field of locks and closures.

BACKGROUND

Closure systems which include bolts that axially move between locked and unlocked positions are in common use both domestically, e.g. in filing cabinets, and also in a variety of installations, such as telecommunication boxes, etc. The axial bolts in such a closure system are, typically, coupled to a knob or handle in such a manner that rotation of the knob or handle induces axial movement of the bolts. The handle or knob may be provided with an integral locking arrangement operated by a key, combination lock, etc., for locking the closure. However, such closures can be easily tampered with and afford relatively low level security.

High level security closure systems are typically costly and complex. Cost considerations and complexity are a stumbling block for increased level of security of such closures.

There is often a desire to convert a relatively low security closure into a higher security one. However, cost and complexity often impose a barrier to do so widely.

GENERAL DESCRIPTION

In accordance with this disclosure, a lock is provided that can be fixed to a variety of closures of different configurations to thereby provide another closure protection measure.

One, non-limiting, example of use of the lock of this disclosure is in a door closure with at least one pair of elongated door bolts of a kind that can displace axially between locking and unlocking (open) positions and are coupled such that they are jointly displaced between the two positions. Such bolts are typically functionally coupled to a door knob or handle, operation of which, e.g. through rotation, induces such displacement. Where the bolts are coupled to a door knob or handle that is operated by rotation, the bolts typically extend form a hub of the knob or handle to the closure's periphery. A closure of the kind discussed in this paragraph will be referred to herein, at times, as a "two axial-bolts closure".

It should, however, be noted that use in a two-axial bolts closure is one example of many. Other examples are use of such locks in locking of containers, or locking a vehicle by fixing to two parts that are displaced on versus the other in operation of the vehicle (e.g. the steering wheel and one of the pedals in a car, or the handle bar and the wheel in a bicycle or motorcycle).

Provided by this disclosure is a lock that comprises a first and second elongated lock members, an electrically-driven blocking arrangement and an electric control mechanism. The first and second elongated lock members are telescopically fitted one into the other and jointly define an axis extending between a first end of the first member and a second end of the second member. The two members can be axially displaced with respect to one another between one or more locking states and one or more open states. In some manifestations of this disclosure there is only one locking state. This may be the case, for example, for a lock with a well defined intended use with a single locked state; e.g. in the case of a lock for use in a two axial-bolts closure. In other examples, such as in the case of a lock for use in a vehicle, there may be a need to define multiple locking states to accommodate various distances between the elements to be locked in different vehicle models.

The electrically-driven blocking arrangement is (i) housed within one or both of the two members, and (ii) has two extreme operational states: a blocking state, in which relative axial displacement of the two lock members is blocked, and a facilitating state, in which the relative axial displacement is enabled. The electric control mechanism is associated (through wired or wireless link) with the blocking arrangement for causing said arrangement to switch between the blocking and the facilitating states.

The lock may comprise integral attachment members or may be associated with attachment members. The attachment members are intended for fixing the lock to an installation or a closure system to be locked by it. The attachment members may be configured, for example, for fixing to axial door bolts.

Typically, albeit not exclusively, the lock is configured such that in the locking state the two lock members are extended one versus the other as compared to the open state. However, the lock may also be oppositely configured, such that in the locking state the two lock members are contracted one versus the other as compared to the open state. The terms "extended" and "contracted" denote that the ends of the first and the second members are, respectively, more distant and more proximal with respect to one another.

Typically, the first member has at least one opening in its sidewalls and the second member has at least one set of recesses corresponding to each of the at least one opening. Within the context of the present invention, the term "recess" is meant to encompass a local recess, a circumferential groove or slit, or a circumferential channel.

Each such opening is aligned with one of the corresponding recesses in the one or more locking states and is configured to accommodate a blocking element, e.g. a ball-shaped element. Thus, locking of the lock is achieved by blocking (arresting) the blocking elements within the recess through an appropriately configured blocking arrangement that can switch between a blocking state, in which it blocks said elements in position by not permitting their inward radial displacement, and a facilitating state permitting such displacement.

A lock according to the teaching herein may comprise one recess in the internal sidewall of the second member for each opening in the walls of first member. In such a case the lock has a single locking state in which such recess aligns said opening and accommodates the blocking element. However, it is also possible to have a set of recesses for each of the openings, whereby the lock may have a plurality of locking states corresponding to the number of recesses in the set. Thus, when a first recess of a set aligns its corresponding opening in the sidewall of the first member the lock may switch into a first locking state; when a second recess aligns with the opening the lock may enter a second locking state; etc.

By one embodiment of this disclosure (the "solenoid embodiment"), the electric mechanism comprises a solenoid and the switch between the two operational states of the blocking arrangement is achieved through the displacement of a solenoid plunger between a pulled-in position and a pushed-out position. The solenoid is, typically, axially oriented such that the movement of the plunger between the pulled-in and pushed-out positions is axial.

In the solenoid embodiment the blocking arrangement may comprise a slider that is axially displaceable between its two functionally distinct states: (i) the blocking state, in which it obstructs the radial movement of the blocking elements out of the recess to thereby maintain the first and second members in the locking state, and (ii) the facilitating state, in which the blocking elements can radially move out of the recess to thereby permit relative axial displacement of the first and second members into the open state. The slider is associated with an urging element, e.g. a spring that urges the slider into the blocking state. As noted above, the lock of this embodiment comprises a solenoid with a solenoid plunger, the plunger being switchable between a pulled-in and a pushed-out position and having a leading element or portion that defines a leading end of the plunger that bears on the slider to displace it into the facilitating state.

The solenoid plunger may comprise an axially compressible elastic element at its leading end. The axially compressible elastic element may be constituted by an auxiliary plunger that can axially displace relative to the solenoid plunger between drawn-in and pressed-out states against the bias of a biasing element, e.g. a spring, that biases the auxiliary plunger into the pressed-out state.

By another embodiment of this disclosure (the "electric motor embodiment"), the electric mechanism comprises an electric motor. The blocking arrangement in the electric motor embodiment comprises a rotating element, coupled to the electric motor and rotatable thereby. The rotating element can rotate between a blocking state, in which it obstructs the radial movement of the blocking elements out of the recess to thereby maintain the first and second members in a locking state, and a facilitating state, in which the blocking elements can radially move out of the recess to thereby permit axial relative displacement of the first and second members into an open state.

The lock of this disclosure may also comprise one or more radially-urged and radially displaceable pins, being part of or being associated with said first member with said second member comprising corresponding one or more pin-receiving recesses formed in its internal walls. In the locked state said pin-receiving recesses align with and accommodate heads of the pins. The pin-receiving recesses are configured to engage the pins' heads in a manner such as to permit inward radial displacement of the pins upon relative displacement of the two lock members in one axial direction and not upon axial displacement in the opposite direction. For example, where the locking state is extended relative to the open state, said one direction is one of relative contraction; and the pin-receiving recess may then be configured with walls that are slanted from the recess's interior towards said second end.

By one implementation of the teaching of this disclosure, the control mechanism may be housed within the first or the second lock members. By another implementation the control mechanism may be a module external to the two lock members that is electrically coupled to the blocking arrangement. The coupling may be wired or wireless.

The control mechanism may comprise or may be coupled to a sensing utility for receiving an activation signal for opening of the lock, e.g. transmitted from a user carried device. Such an activation signal may, for example be electromagnetically transmitted, e.g. by the use of the Bluetooth communication protocol, may be an optic signal, e.g. infrared signal or may be an acoustic signal, e.g. a knocks-based access control signal of the kind disclosed in PCT publication no. WO 98/39539, in which case the sensing utility may comprise an acoustic pick-up sensor of the kind disclosed in PCT publication no. WO 01/59238.

Provided by another aspect of this disclosure, as noted above, is a closure comprising a lock as disclosed herein. One example is a two axial-bolts closure that comprises at least one pair of bolts that are coupled to one another to be jointly axially displaceable towards each other into an unlocked position and away from each other into a locked position. A lock of this disclosure is then fixed to the two axial bolts and, as long as the lock is in a locking state it does not permit axial displacement of the bolts from a locked to an unlocked position. In the axial displacement from their locked to their unlocked position, the bolts move towards one another, namely any two points on one of each of a pair of bolts, are closer to one another in the unlocked state than in the locked position. The lock in such a case is one in which the open state is contracted relative to the locking state. The lock is firmly attached to each of a pair of bolts and as long as it is in a locking state, it stops the bolts from displacing one versus the other, to thereby firmly secure them in their locked position. Once the lock is switched to an open state it allows the points of attachments to move one towards the other, thereby permitting the bolts to displace to their unlocked position.

Provided by another aspect is, also, a door closure, comprising at least one pair of axial door bolts and a lock according to this disclosure.

As can also be appreciated, in order to further increase the security level, use of more than one lock of this disclosure may also be envisaged; for example two locks fixed to the same pair of bolts; or in a closure system that comprises 3, 4 or a plurality of bolts, each lock may be fixed to a different pair of bolts. Where a closure includes more than one lock, operation of both may be controlled by a single control utility or each may have its independent control utility, and accessed by the same or different code.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIG. 5A shows the lock in its locking state;

FIG. 5B shows the lock after activation of the solenoid and displacement of the solenoid plunger from its rear position into a more forward position, in which it bears on and applies pressure onto the slider;

FIG. 5C shows the lock after the slider has been displaced from its ball-blocking state in FIGS. 5A and 5B, to a more forward, facilitating state;

FIG. 5D shows the lock in its fully retracted state; and

FIG. 5E shows the lock in an interim state towards a fully extended and locking state shown in FIG. 5A.

DETAILED DESCRIPTION OF EMBODIMENTS

The current disclosure will be illustrated by a specific description of lock configured according the solenoid embodiment of the invention in which the open state is relatively contracted from the locking state. The specifically described utility of this lock is its implementation in a two axial-bolts closure. It should however be noted that this illustration is not intended to be limiting but rather intended to exemplify the invention disclosed herein that encompasses the full scope of this disclosure.

Figure 1A:
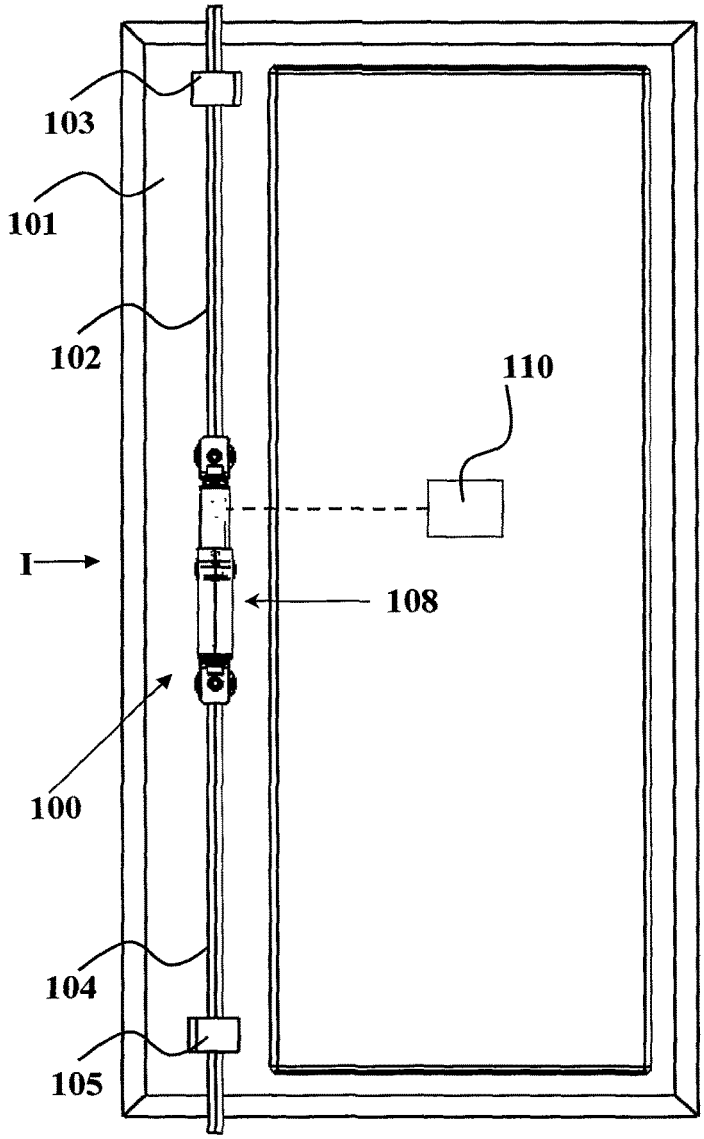
FIG. 1A shows a view from a door's interior of a closure system according to one embodiment of this disclosure with a lock in a locking state.

Referring first to FIG. 1A, shown is a two axial-bolts closure system generally designated 100 fitted in the interior of a door 101. The closure system 100 has two oppositely oriented bolts 102, 104 coupled to a knob 106. The coupling is such that rotation of the knob 106 causes the bolts to substantially axially displace between the locked position shown in FIGS. 1A and 1B, and the unlocked position shown in FIG. 2. In their locked position, the end of each of the bolts 102, 104 fits into a matching bolt receptacle, e.g. cavity or recess formed in the frame of the door (not shown). The axial displacement of the bolts is guided by guiders 103, 105. Fixed to this pair of substantially oppositely oriented bolts is a lock 108 which is tightly fixed at each of its ends to the bolts via attachment members that are seen clearly in FIG. 3 and that will be described below. As a consequence of this tight fixing, the substantially axial displacement of the bolt from the locked to the unlocked position is accompanied by a contraction of lock 108 and the opposite displacement of the bolts is accompanied by an extension of the lock. The lock 108 is linked to a control mechanism shown schematically as box 110.

The control mechanism may be a separate unit linked to the lock by wire or wireless link and may also, by some examples, be integral with the lock. The control mechanism is adapted to receive an access control signal, which may be a knocks-based access control signal of the kind disclosed in PCT publication no. WO 98/39539, in which case the control mechanism may include an acoustic pick-up sensor of the kind disclosed in PCT publication no. WO 01/59238.

It should further be noted that the invention is not limited to a control mechanism housing an acoustic sensor picking up a code encoded as a series of knocks and may be designed for picking up codes transmitted through other means such as visible or infrared light (in which case the sensor should have a line of sight to the exterior), Bluetooth, radio waves, and other communication links. The control mechanism, by some examples, may also be linked to an external socket accessible to an operator and the code may then be inputted by connecting an appropriate access control device to that socket.

In addition, as will be explained later, the lock of this solenoid embodiment comprises a solenoid that requires an electric power source. The power source may be embedded within the lock, may be included in the control mechanism or may be a separate unit. The invention is not limited by the manner in which the electric power is supplied to the lock or control mechanism. For example, in the case where there is an external socket, the power for operation may also be applied from the exterior, e.g. by the access control device.

Figure 1B:
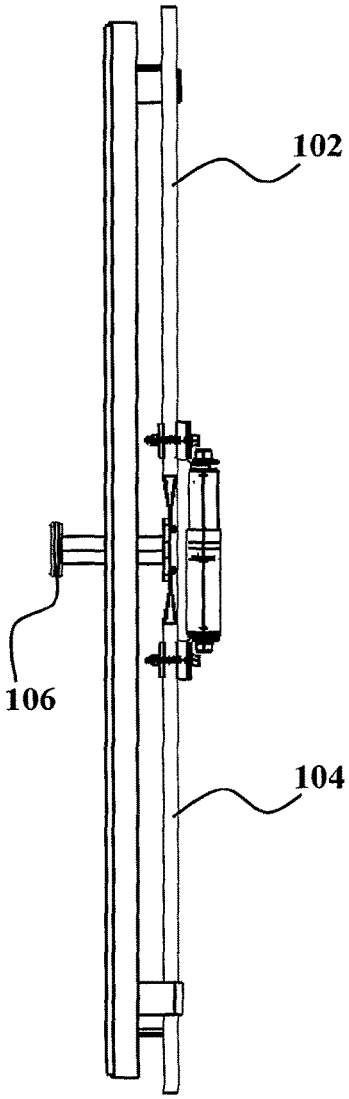
FIG. 1B is a view of the closure system in the direction of arrow I in FIG. 1A.
Figure 2:
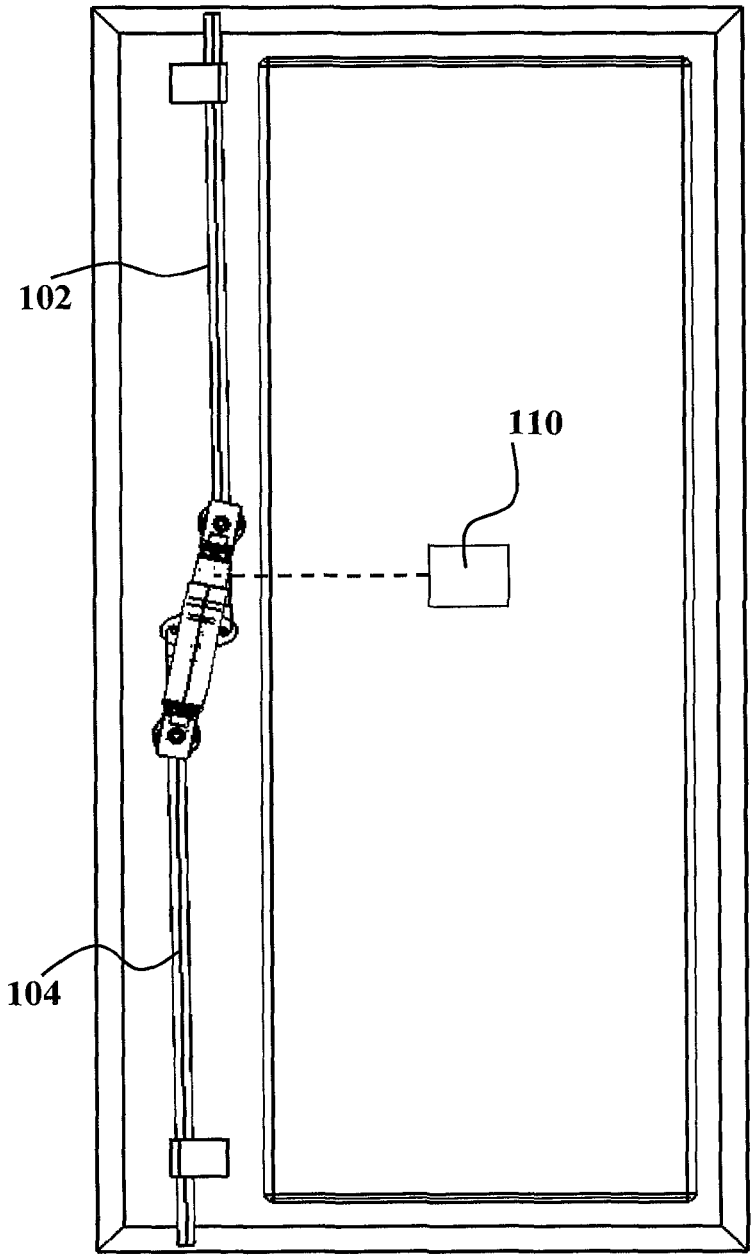
FIG. 2 shows the closure system of FIGS. 1A and 1B in the open state.

In FIGS. 1A and 1B, the lock 108 is in its fully extended, locking state. As can be seen in FIG. 2, the lock contracts as a result of the axial displacement of the bolts to the unlocked state. As will be explained further below, the lock has an internal arrangement that arrests the lock in its fully extended state shown in FIGS. 1A and 1B, as long as the internal mechanism is not activated to permit contraction and hence opening of the closure system to the state shown in FIG. 2.

Figure 3:
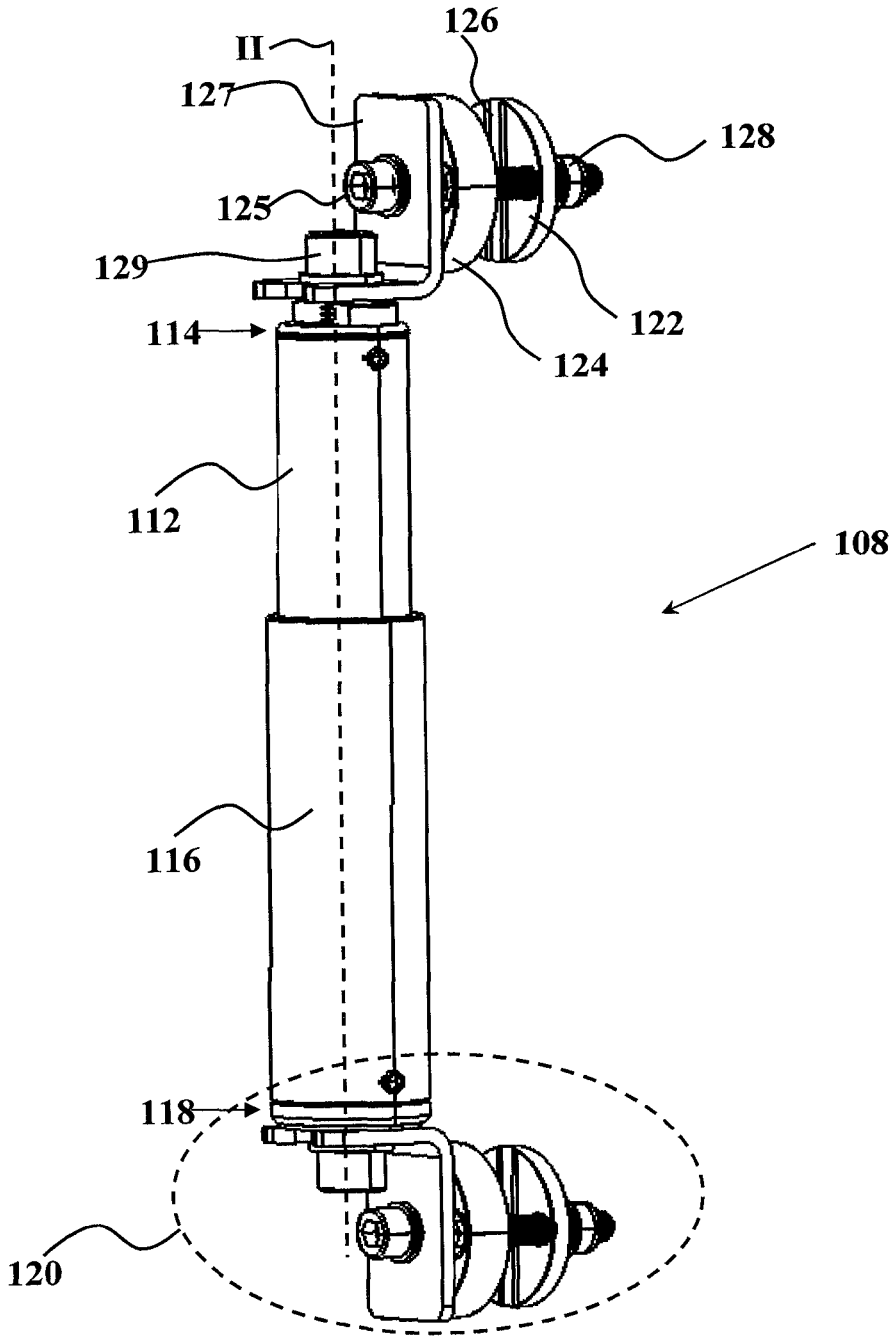
FIG. 3 is a perspective view of the lock.

Lock 108 is seen in isolation in FIG. 3. It is generally elongated having two cylindrical members including a first member 112 defining a first end 114, telescopically fitted into a second cylindrical member 116 defining a second end 118 of the lock. The lock 108 defines an axis II extending along the device between the two ends 114, 118. For ease of description of this embodiment the axis will regarded as extending arbitrary in the rearward-forward direction extending between respective first 114 and second 118 ends. Thus, the terms "rear", "forward" and any lingual variations thereof should be understood with reference to this arbitrary direction.

Figure 4A:
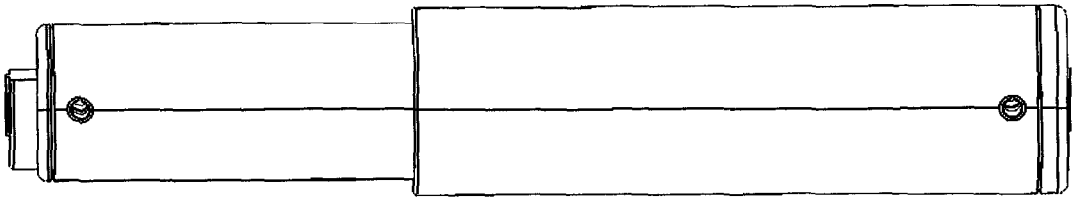
FIGS. 4A and 4B are side views of the lock of FIG. 3 in respective extended and retracted states.
Figure 4B:
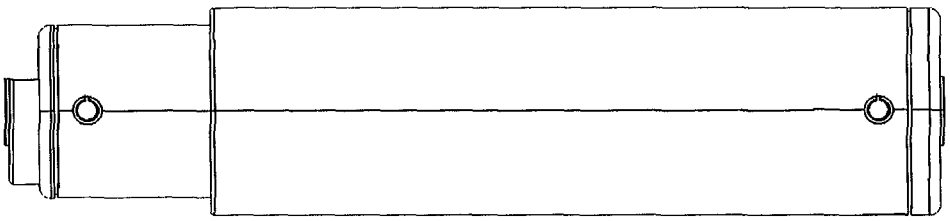

The two members are axially displaceable with respect to one another, between the extended state shown in FIGS. 3 and 4A, which is the state of the lock in FIGS. 1A and 1B (i.e. the locked state) and the retracted state shown in FIG. 4B, which is the state of the lock in FIG. 2 (the open state). As can further be seen in FIG. 3, fitted to each of first and second ends are attachment members 120 including two clamping disks 122, 124 formed with an axial groove, of which only groove 126 formed in disk 122 is seen but there is typically also an opposite one formed in disk 124 (not shown in this view). The two disks can be pressed one against the other through rotation of a pair of clamping nuts 128 (only one of which is seen in this view), the other one being on the opposite side of disk 122. Disk 124 is fitted through bolt 125 to an L-shaped plate 127 that is fixed to an end of the lock through nuts 129. As can be appreciated the attachment members may be replaced, if needed, by others to fit specific dimensions and configurations of the specific closure system. Through this, the lock is not specific for a specific type of closure but rather may be a generic one that can be used in closure of many different kinds.

The internal arrangement and the mechanism of operation of the lock will now be described with reference to FIGS. 5A to 5E, which are longitudinal cross-sections at various operational stages of the lock.

Figure 5A:
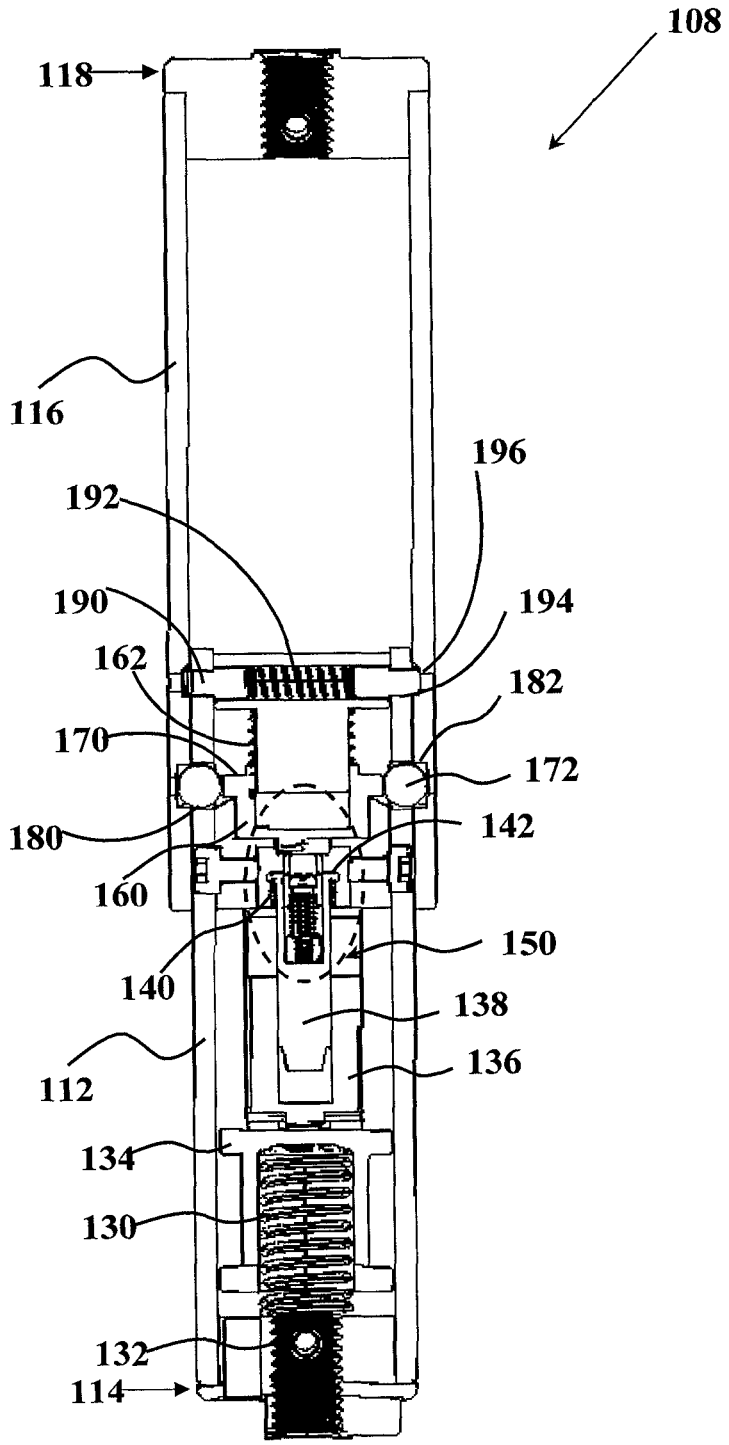
FIGS. 5A-5E are longitudinal cross-sections of the lock in several operational states, where.

The telescopic engagement of the two members 112, 116 is clearly seen in FIG. 5A. The blocking arrangement responsible for switching the lock between the blocking state shown in FIG. 5A and the facilitating state shown in FIGS. 5C to 5E, which is housed within the lumen of first member 112, will now be described. Seen is a spring 130 that has no functional significance for the lock's operation other than an assembly aid for bringing the solenoid 136 into its position within the first member. Spring 130 is confined between nut 132 and a base plate 134 of the solenoid 136.

Solenoid 136 includes a solenoid plunger 138 that is switchable between its rear position seen in FIG. 5A and fore position through activation of the solenoid. The solenoid plunger 138 has associated biasing spring 140 fitted around the external portion of the solenoid plunger 138 and is confined in position by shoulders 142. The solenoid plunger 138 also comprises an axially compressible elastic element at its front end, generally designated 150. It includes an auxiliary plunger 152 that can axially displace relative to the solenoid plunger, between a drawn-in state shown in FIG. 5A and a pressed-out state that will be illustrated below. The auxiliary plunger 152 is biased into the drawn out state by spring 154. As will also be described below, the auxiliary plunger 152 when displaced to its pressed-out state comes to bear on slider 160.

Slider 160 can slide between a rearward position shown in FIG. 5A, which is a blocking state, in which it obstructs inward radial displacement of blocking elements 172 (described below) and a forward position shown in FIG. 5D, which is a facilitating state permitting inward radial displacement of elements 172. Slider 160 has an associated urging element that is constituted by a spring 162 which urges the slider into the rearward position. Slider 160 has a main portion 169 and an obstructing portion that is constituted as shoulders 170 that in the state shown in FIG. 5A obstruct the radial displacement of blocking elements, constituted as balls 172, to hold them firmly in their position.

As can further be seen, the walls of first member 112 have an opening 180 which in the position shown in FIG. 5A is aligned with recesses, at this specific embodiment constituted as circumferential groove 182 formed on the internal face of the second member 116. In this blocking state of the slider, balls 172 are fixed within the groove 182 and this causes the first and second members to be locked in the extended state and their retraction is inhibited. In this specific embodiment, the lock includes combination of two opening-recess-balls but in other embodiments there may be 3, 4, 5, 6, etc. or at times even 1.

Another element that can be seen in FIG. 5A are two pins 190 radially urged by spring 192 through openings 194 formed in the side walls of member 112 and into recesses (circumferential groove) 196 formed in side walls of member 116. In this state, openings 194 and groove 196 are aligned.

Figure 5B:
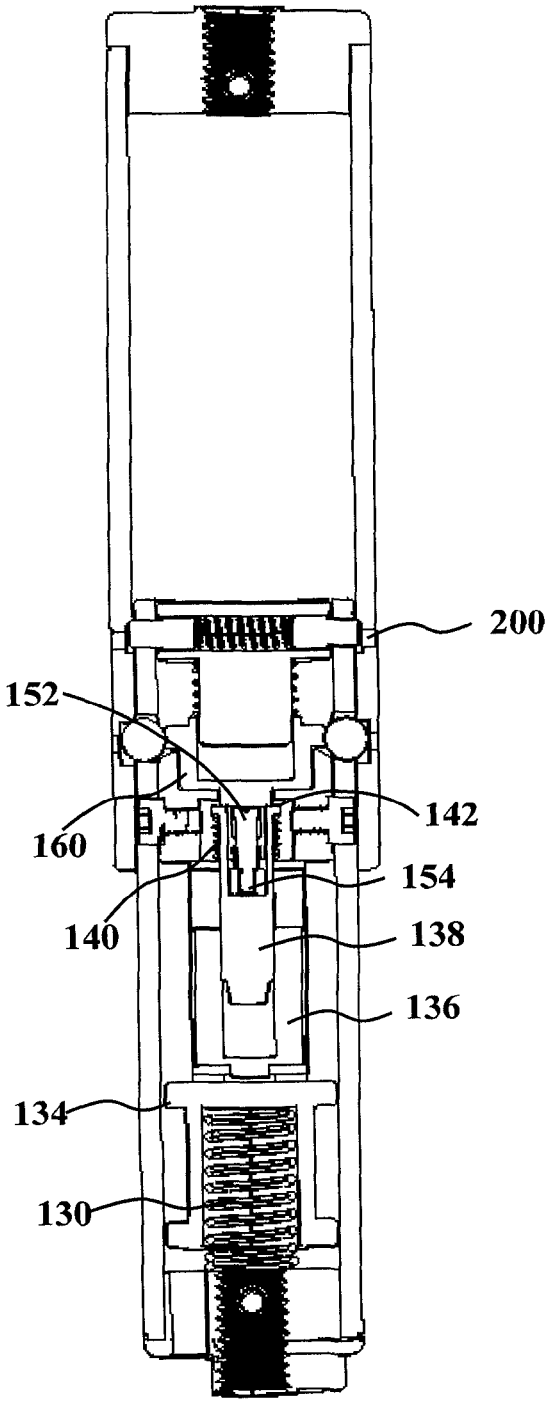

As can best be seen, for example in FIG. 5B, groove 196 has walls that are slanted from the interior in the foreword direction. Thus, upon retraction of the first and second members, this slanted wall guides the two pins to radially contract and, therefore, do not block such retraction. Against this, upon extension, once the alignment in FIG. 5A is achieved, the pins snap, by the urging force of spring 192, back into groove 196 and arrest the two members in the state shown in FIG. 5A from further extension. This is important to ensure that the lock is not unintentionally disassembled, e.g. prior to or during its installation within a closure system. Openings 200 in the side walls of the second member that open into groove 196 enable insertion of appropriate tools to radially press on the pins to permit intentional disassembly.

Figure 5C:
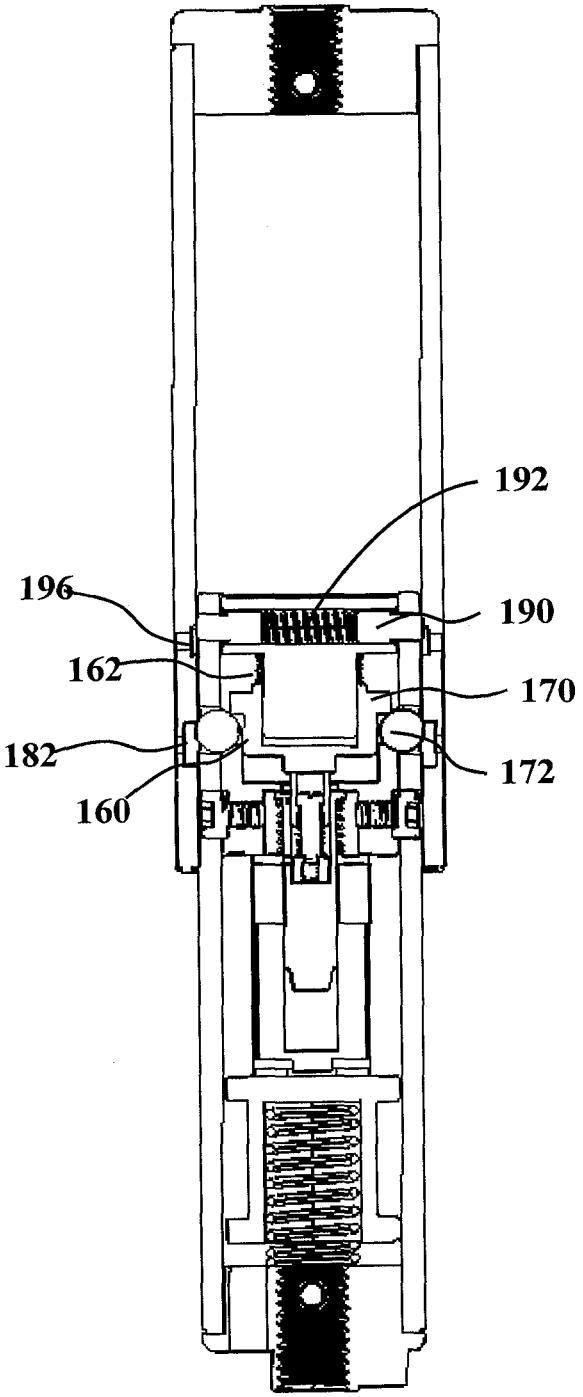

Upon activation of the solenoid through a proper activation code received by the control mechanism, solenoid plunger 138 switches between a pulled-in position to a pushed-out position by the biasing force of spring 140 and consequently, the leading, front end of auxiliary plunger 152 bears onto slider 160 and as a result its associated spring 154 is compressed. Spring 154 acts as a kind of an energy storage buffer to temporarily store and release the forward bias energy of the solenoid plunger 138 to cause the eventual displacement of slider 160. As seen in FIG. 5C, this causes slider 160 to move forward towards facilitating state, against the urging force of spring 162, which is compressed. As can be appreciated the properties of the different springs are such that the forward force applied by each one of plunger-associated springs 140 and 154 is stronger than the reverse force applied by spring 162 which permits the forward displacement of the slider.

Once slider 160 is displaced, shoulders 170 no longer bear on balls 172 and consequently these can radially move out of groove 182 into the position shown in FIG. 5C and permit retraction of members 112 and 116 toward one another. It should be noted that the balls 172 are dimensioned to be about or slightly less than the distance between main portion 169 and the internal face of member 116. As noted, once the balls move out of the recesses, the two members 112 and 116 can contract, which causes pins 190 to radially contract as well, as explained above.

Figure 5D:
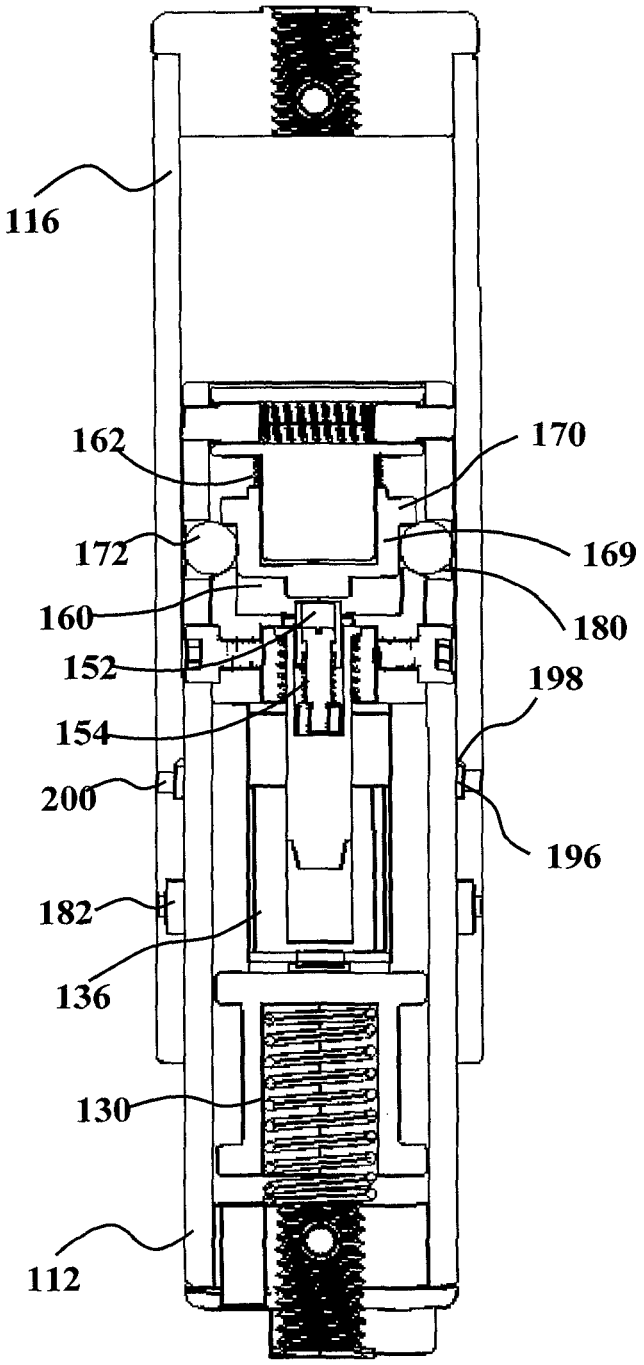

This permits the lock to compress to the fully contracted state shown in FIG. 5D, which corresponds to that shown in FIG. 2. Upon closing of the closure, knob 106 is rotated causing axial displacement of the bolts towards their locked position which causes the lock to extend.

Figure 5E:
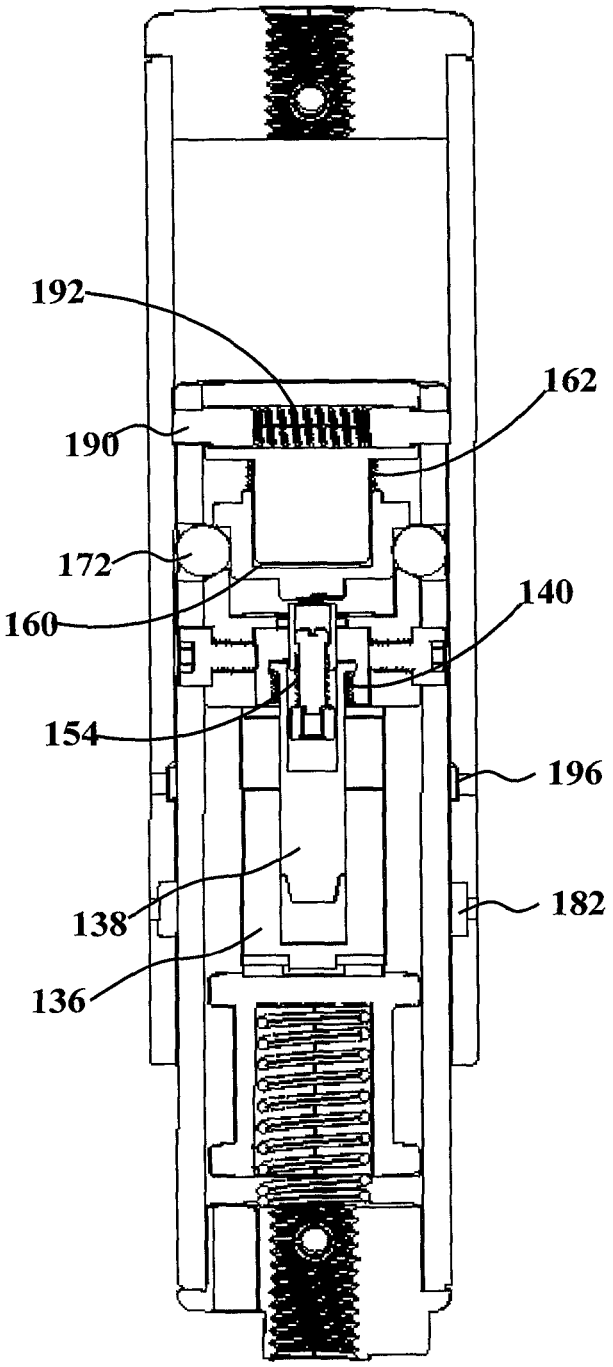

The control mechanism of solenoid 136 is such that it is typically switched to cause the solenoid plunger to shift to the position shown in FIG. 5B for a defined time period, e.g. of a few seconds, in which the closure can be opened. After this period, the solenoid plunger is retracted as shown in FIG. 5E to assume a locking stand-by position. Once pins 190 snap back into groove 196, slider 160 is allowed to move back to the obstructing position as in FIG. 5A, forcing balls 172 into groove 182. This stand-by position allows the closure to be locked automatically once the bolts are displaced into their blocking state.

The invention claimed is:

1. A lock, comprising:

first and second elongated lock members wherein (i) the first member fitting telescopically into the second member and the two members jointly define an axis extending between a first end of the first member and a second end of the second member, and (ii) the two members can axially displace with respect to one another between one or more locking states and one or more open states, the first member has at least one opening in sidewalls thereof and the second member has at least one set of recesses corresponding to each of the at least one opening, the opening being aligned with one of the corresponding recesses in the one or more locking states and being configured to accommodate a blocking element;

an electrically-driven blocking arrangement that is (i) housed within one or both of the two members, and (ii) having a blocking state, in which relative axial displacement of the two lock members is blocked, and a facilitating state, in which the relative axial displacement is enabled; and an electric control mechanism associated with the blocking arrangement for causing said arrangement to switch between the blocking and the facilitating states, the blocking arrangement comprises a slider that is axially displaceable between (i) the blocking state in which the slider obstructs the radial movement of the blocking element out of the recess to thereby maintain the first and second members in the locking state and (ii) the facilitating state in which the blocking elements can radially move out of the recess to thereby permit relative axial displacement of the first and second members into the open state; the slider being associated with an urging element, that urges the slider into the blocking state; and a solenoid with a solenoid plunger switchable between a pulled-in and a pushed-out positions and having a leading element or portion that defines a leading end that bears on the slider to displace the slider into the facilitating state.

2. The lock of claim 1, wherein the electric mechanism comprises a solenoid.

3. The lock of claim 1, wherein the electric mechanism comprises an electric motor.

4. The lock of claim 1, comprising attachment members for fixing the lock to an installation or a closure system to be locked by the lock.

5. The lock of claim 4, wherein the attachment members are configured for fixing to axial door bolts.

6. The lock of claim 1, wherein in the locking state the two lock members are extended one versus the other as compared to the open state.

7. The lock of claim 1, wherein in the locking state the two lock members are contracted one versus the other as compared to the open state.

8. The lock of claim 1, wherein the solenoid plunger comprises an axially compressible elastic element at a leading end thereof.

9. The lock of claim 8, wherein the solenoid plunger comprises an auxiliary plunger at a leading end thereof that can axially displace relative to the solenoid plunger between drawn-in and pressed-out states against the bias of a biasing element that biases the auxiliary plunger into the pressed-out state.

10. The lock of claim 1, wherein the control mechanism is housed within the first or the second lock members.

11. The lock of claim 1, wherein the control mechanism is a module external to the two lock members and is electrically coupled to the blocking arrangement.

12. The lock of claim 11, wherein the coupling is wired or wireless.

13. The lock of claim 10, wherein the control mechanism comprises an acoustic sensing utility having an acoustic sensor and a processor for picking up and identifying an activation signal encoded in the form of a series of knocks.

14. A door closure comprising a lock according to claim 1.

15. A door closure comprising at least one pair of door bolts that are coupled to one another to be jointly axially displaceable towards each other into an unlocked position and away from each other into a locked position; and the lock according to claim 1 fixed at one end to one of a pair of bolts and at a second end thereof to the other of a pair of bolts.

16. A lock, comprising:

first and second elongated lock members wherein (i) the first member fitting telescopically into the second member and the two members jointly define an axis extending between a first end of the first member and a second end of the second member, and (ii) the two members can axially displace with respect to one another between one or more locking states and one or more open states, the first member has at least one opening in sidewalls thereof and the second member has at least one set of recesses corresponding to each of the at least one opening, the opening being aligned with one of the corresponding recesses in the one or more locking states and being configured to accommodate a blocking element;

an electrically-driven blocking arrangement that is (i) housed within one or both of the two members, and (ii) having a blocking state, in which relative axial displacement of the two lock members is blocked, and a facilitating state, in which the relative axial displacement is enabled;

an electric control mechanism associated with the blocking arrangement for causing said arrangement to switch between the blocking and the facilitating states the blocking arrangement comprises a rotating element that can rotate between a blocking state, in which the rotating element obstructs the radial movement of the blocking element out of the recess to thereby maintain the first and second members in a locking state, and a facilitating state, in which the blocking elements can radially move out of the recess to thereby permit axial relative displacement of the first and second members into an open state; and an electric motor coupled to said rotating element for causing the rotating element to rotate between the blocking and the facilitating states.

17. A lock, comprising:

first and second elongated lock members wherein (i) the first member fitting telescopically into the second member and the two members jointly define an axis extending between a first end of the first member and a second end of the second member, and (ii) the two members can axially displace with respect to one another between one or more locking states and one or more open states;

an electrically-driven blocking arrangement that is (i) housed within one or both of the two members, and (ii) having a blocking state, in which relative axial displacement of the two lock members is blocked, and a facilitating state, in which the relative axial displacement is enabled;

an electric control mechanism associated with the blocking arrangement for causing said arrangement to switch between the blocking and the facilitating states; and one or more radially-urged and radially displaceable pins being part of or being associated with said first member, said second member comprises corresponding one or more pin-receiving recesses formed in internal walls thereof that in the locked state align with and accommodate heads of the pins; said pin-receiving recesses being configured to engage the pin head in a manner such as to permit inward radial displacement of the pins upon relative displacement of the two lock members in one direction and not upon the opposite direction.

18. The lock of claim 17, wherein said one direction is a relative retraction of the two members.

19. The lock of claim 17, wherein the pin-receiving recesses have walls that are slanted from an interior of the recess towards the second end to thereby guide the pins to inwardly radially displace upon displacement of the two lock members in said one direction.

* * * * *